US011397034B2

(12) United States Patent
Schwoeppe

(10) Patent No.: US 11,397,034 B2
(45) Date of Patent: Jul. 26, 2022

(54) UNLOADING SYSTEM FOR VARIABLE SPEED COMPRESSOR

(71) Applicant: Carrier Corporation, Palm Beach Gardens, FL (US)

(72) Inventor: Brandon Schwoeppe, Camillus, NY (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 117 days.

(21) Appl. No.: 16/454,572

(22) Filed: Jun. 27, 2019

(65) Prior Publication Data

US 2020/0003220 A1 Jan. 2, 2020

Related U.S. Application Data

(60) Provisional application No. 62/690,683, filed on Jun. 27, 2018.

(51) Int. Cl.
*F04D 27/02* (2006.01)
*F25B 41/20* (2021.01)

(52) U.S. Cl.
CPC ..... *F25B 41/20* (2021.01); *F04D 27/0269* (2013.01)

(58) Field of Classification Search
CPC ..... F04B 19/12; F04D 27/0269; F25B 41/04
USPC ..... 417/307
See application file for complete search history.

(56) References Cited

U.S. PATENT DOCUMENTS

| | | | | |
|---|---|---|---|---|
| 4,459,817 | A * | 7/1984 | Inagaki | F25B 49/022 417/283 |
| 5,556,271 | A * | 9/1996 | Zuercher | F04C 28/125 418/201.2 |
| 6,434,960 | B1 * | 8/2002 | Rousseau | F25B 1/047 62/228.4 |
| 6,619,062 | B1 | 9/2003 | Shibamoto et al. | |
| 6,925,823 | B2 | 8/2005 | Lifson et al. | |
| 7,332,885 | B2 | 2/2008 | Schnetzka et al. | |
| 7,481,069 | B2 | 1/2009 | Lifson et al. | |
| 7,854,137 | B2 | 12/2010 | Lifson et al. | |

(Continued)

FOREIGN PATENT DOCUMENTS

| | | |
|---|---|---|
| JP | H0960596 A | 3/1997 |
| JP | 2007146698 A | 6/2007 |
| JP | 2013241942 A | 12/2013 |

OTHER PUBLICATIONS

"Compressed Air Efficieny: A Case Study Combining Variable Speed Control with Electronic Inlet Valve Modulation" SAE International, 2012.

(Continued)

*Primary Examiner* — Connor J Tremarche
(74) *Attorney, Agent, or Firm* — Cantor Colburn LLP

(57) ABSTRACT

A variable speed compressor includes a housing assembly having a suction port and an inlet port, a motor disposed within the housing assembly, and at least one rotatable element mounted within the housing assembly. The at least one rotatable element is driven by the motor about an axis of rotation. The variable speed compression additionally includes an unloading system having at least one valve. The unloading system is selectively operable to supplement an unloading of the variable speed compressor defined by an operational speed of the variable speed compressor.

15 Claims, 6 Drawing Sheets

(56) References Cited

U.S. PATENT DOCUMENTS

| | | | | |
|---|---|---|---|---|
| 8,082,747 | B2 * | 12/2011 | Sjoholm | F04C 18/16 62/228.5 |
| 8,408,017 | B2 | 4/2013 | Leaver et al. | |
| 2006/0225445 | A1 | 10/2006 | Lifson et al. | |
| 2008/0223057 | A1 | 9/2008 | Lifson et al. | |
| 2011/0038747 | A1 * | 2/2011 | Shoulders | F04C 29/128 418/201.2 |
| 2016/0146522 | A1 | 5/2016 | Hung | |

OTHER PUBLICATIONS

Howden, [online]; [retrieved on May 22, 2018]; retrieved from the Internet, https://souzimport.ru/upload/files/Howden_M127_6pp_Brochure_SinglePage.pdf, "M127 Industrial-Standard Screw Compressor," Howden Compressors Ltd., Howden.com, 2014, pp. 1-6.

Lee Cline et al., "Variable-Speed Compressors on Chillers" Trane Engineers Newletter Live, 2015.

* cited by examiner

UNLOADING SYSTEM FOR VARIABLE SPEED COMPRESSOR

BACKGROUND

Embodiments of the disclosure relate generally to air conditioning and refrigeration systems, and more particularly, to a valve for use with a variable speed compressor.

Refrigerant systems are utilized in many air conditioning and heat pump applications for cooling and/or heating air provided to an environment. The cooling or heating load of the environment may vary with ambient conditions. occupancy level, other changes in sensible and latent load demands, and as the temperature and/or humidity set points are adjusted by an occupant of the environment.

A compressor is used to compress a working fluid (i e, the refrigerant) from initial (suction) conditions to compressed (discharge) conditions. In some refrigerant systems, a single compressor is utilized to compress the refrigerant and move the refrigerant through the cycle connecting indoor and outdoor heat exchangers in a closed loop. However, under many circumstances, it is desirable to have the ability to vary the capacity, or amount of cooling or heating provided by the refrigerant system.

Use of a variable speed compressor is known to improve the efficiency of a refrigerant system. By driving the compressor at a higher or lower speed, the amount of refrigerant that is compressed per unit of time changes, and thus the system capacity can be adjusted. Often the compressor need not operate at full speed, such as when the cooling load on the refrigerant system is relatively low for example. Under such circumstances, it may be desirable to reduce the compressor speed, and thus the overall energy consumption of the refrigerant system.

In a variable speed compressor, the amount of unloading available is determined by the slowest speed limit at which the compressor can operate reliably. The speed of the variable speed compressor is commonly controlled by a variable frequency drive; however, the variable frequency drive does not provide a mechanism for further unloading the compressor due to thermal and mechanical limitations of the compressor at minimum speed. Accordingly, further unloading of a compressor beyond the lower limit set speed of operation is desirable.

BRIEF DESCRIPTION

According to an embodiment, a variable speed compressor includes a housing assembly having a suction port and an inlet port, a motor disposed within the housing assembly, and at least one rotatable element mounted within the housing assembly. The at least one rotatable element is driven by the motor about an axis of rotation. The variable speed compression additionally includes an unloading system having at least one valve. The unloading system is selectively operable to supplement an unloading of the variable speed compressor defined by an operational speed of the variable speed compressor.

In addition to one or more of the features described above, or as an alternative, in further embodiments the at least one valve is positioned within an opening formed in the housing assembly.

In addition to one or more of the features described above, or as an alternative, in further embodiments the at least one valve is aligned with a working portion of the at least one rotatable element.

In addition to one or more of the features described above, or as an alternative, in further embodiments the at least one valve includes a plurality of valves spaced about a periphery of the housing assembly.

In addition to one or more of the features described above, or as an alternative, in further embodiments the plurality of valves are arranged within a plane oriented substantially perpendicular to the axis of rotation.

In addition to one or more of the features described above, or as an alternative, in further embodiments the at least one valve further comprises a valve body having a first end and a second end, a central bore formed in the valve body, an inlet opening formed at the first end, the inlet opening being arranged in fluid communication with the central bore, and an outlet opening formed in a side of the valve body, the outlet opening being arranged in fluid communication with the central bore.

In addition to one or more of the features described above, or as an alternative, in further embodiments the at least one valve is positioned such that an outlet opening is aligned with a fluid flow path defined between an interior surface of the housing assembly and an exterior of the at least one rotatable element.

In addition to one or more of the features described above, or as an alternative, in further embodiments the at least one rotatable element includes at least one lobe and the inlet opening is arranged in fluid communication with the at least one lobe.

In addition to one or more of the features described above, or as an alternative, in further embodiments the at least one valve further comprises a movable member disposed within the central bore, the movable member being movable between a first position and a second position.

In addition to one or more of the features described above, or as an alternative, in further embodiments the at least one valve is a poppet valve.

In addition to one or more of the features described above, or as an alternative, in further embodiments the movable member is arranged in the first position when the unloading system is non-operational.

In addition to one or more of the features described above, or as an alternative, in further embodiments when the movable member is in the first position, the movable member seals both the inlet opening and the outlet opening.

In addition to one or more of the features described above, or as an alternative, in further embodiments the movable member is arranged in the second position when the unloading system is operational.

In addition to one or more of the features described above, or as an alternative, in further embodiments when the movable member is in the second position, the inlet opening and the outlet opening are fluidly coupled.

In addition to one or more of the features described above, or as an alternative, in further embodiments the unloading system further comprises a drive mechanism configured to move the movable member between the first position and the second position.

In addition to one or more of the features described above, or as an alternative, in further embodiments the drive mechanism includes a solenoid.

In addition to one or more of the features described above, or as an alternative, in further embodiments when the drive mechanism is inactive, the movable member is configured to automatically transform from the second position to the first position.

In addition to one or more of the features described above, or as an alternative, in further embodiments the movable member is configured to automatically transform from the second position to the first position via gravity.

In addition to one or more of the features described above, or as an alternative, in further embodiments comprising a biasing member disposed between the movable member and the valve body, wherein a biasing force of the biasing member is configured to automatically transform the movable member from the second position to the first position.

In addition to one or more of the features described above, or as an alternative, in further embodiments the at least one rotatable element includes a male screw rotor and a female screw rotor.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

The term "about" is intended to include the degree of error associated with measurement of the particular quantity based upon the equipment available at the time of filing the application.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

Figure 1:
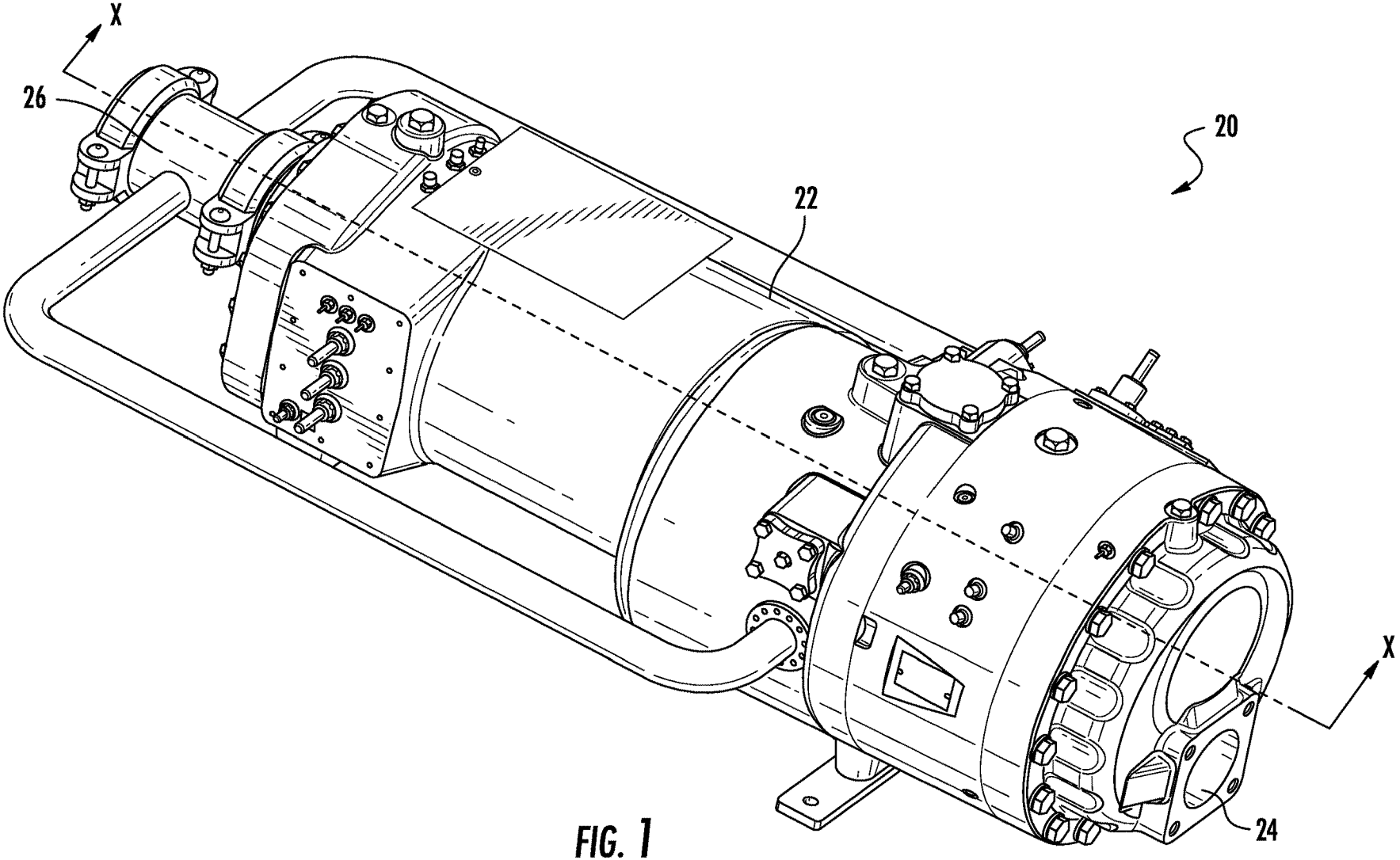
FIG. 1 is a perspective view of an example of a compressor.
Figure 2:
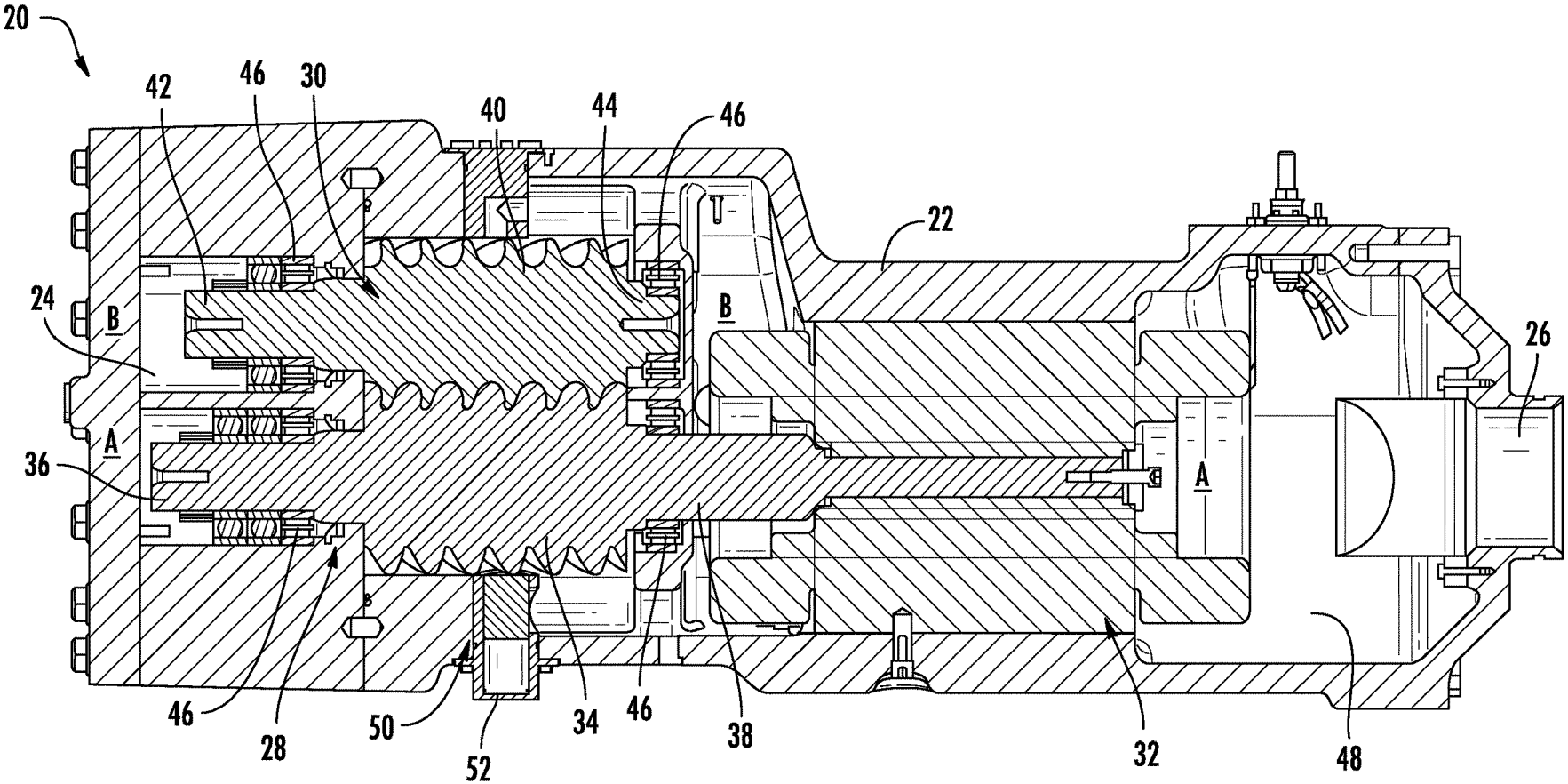
FIG. 2 is a cross-sectional view of the compressor of FIG. 1 taken along line X-X according to an embodiment.
Figure 3:
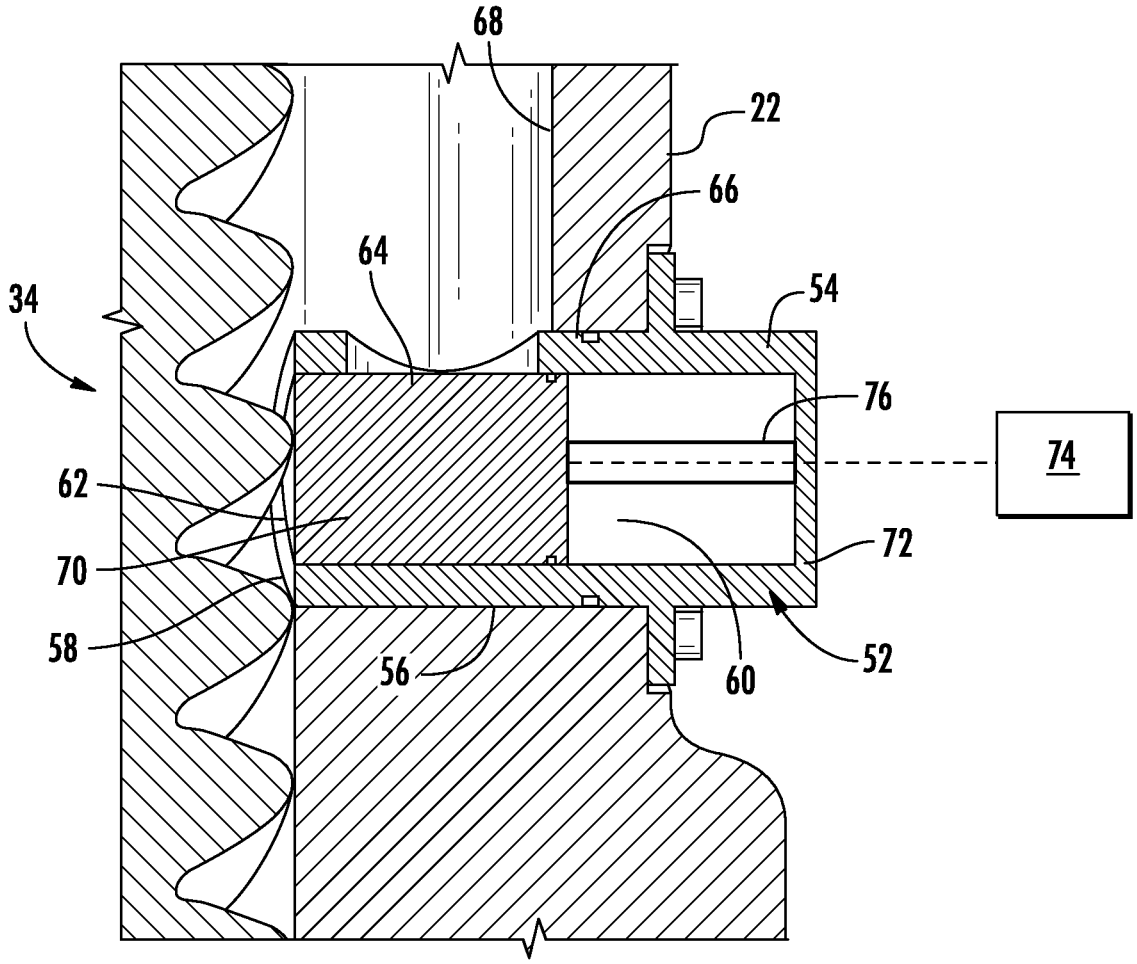
FIG. 3 is a detailed cross-sectional view of a valve of an unloading system of a compressor in a first position according to an embodiment.
Figure 4:
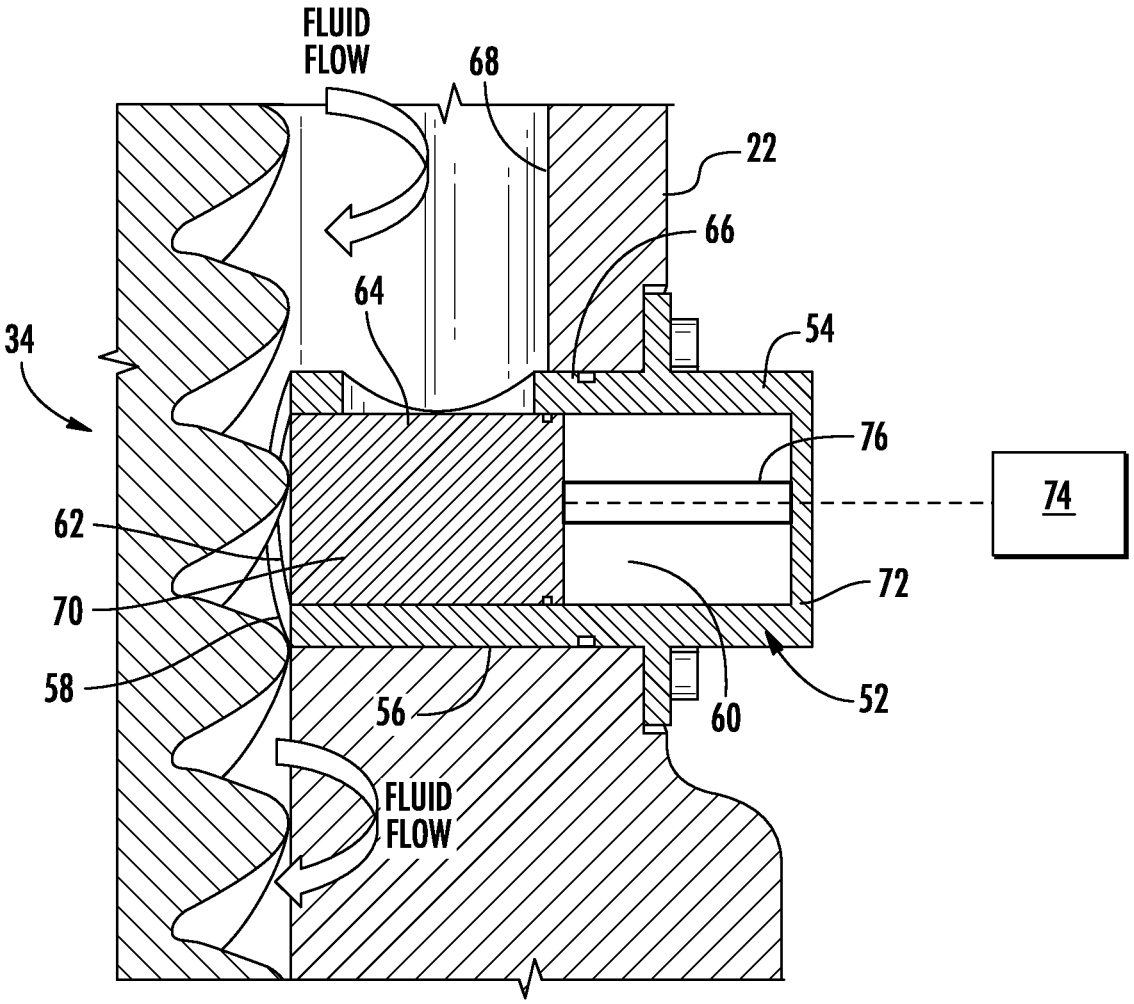
FIG. 4 is a detailed cross-sectional view of a valve of an unloading system of a compressor in a first position according to an embodiment.

Referring now to FIGS. 1 and 2, a perspective and cross-sectional view of an example of a screw compressor, commonly used in refrigerant systems, is illustrated. The compressor 20 includes a housing assembly 22 defining at least one inlet or suction port 24 and at least one outlet or discharge port 26 with a fluid flow path there between. To drive a flow, the compressor 20 includes a plurality of lobed rotors 28, 30 driven by one or more motors 32. In an embodiment, the rotor 28 is a male rotor having a male-lobed working portion 34 and shaft portions 36 and 38 protruding from opposite ends of the working portion 32. Similarly, the compressor includes at least one female rotor 30 having a female-lobed working portion 40 enmeshed with the working portion 34 of the male rotor 28. The female rotor 30 additionally includes shaft portions 42 and 44 protruding from opposite ends of the working portion 40. The shaft portions 36, 38, 42, 44 are supported by appropriate bearings 46 for rotation of the rotors 28, 30 about respective axes A and B.

In the illustrated, non-limiting embodiment, the motor 32 is an electric motor, such as an induction, permanent magnet (PM), or switch reluctance motor for example, and includes a rotor and a stator. A shaft portion 38 of one of the rotors 28 is coupled to and driven by the motor 32 about its axis A. As a result, when the shaft portion 38, and therefore the screw rotor 28 is driven in a first direction about its axis A by the motor 32, the rotor 28 drives the other rotor 30 in a second, opposite direction about its axis B via the intermeshing engagement therewith.

During operation, a low pressure working fluid, such as refrigerant for example, enters the compressor 20 via the inlet 24, and travels through the housing 22 along a fluid flow path. At the rotors 28, 30, the low pressure working fluid enters the compression pockets formed between the lobes of the male and female working portions 34, 40. As the rotors 28, 30 rotate about their respective axes A, B, the volume of the compression pockets gradually reduces, thereby compressing the fluid contained within the pocket as the pocket translates between lobes over the length of the working portion 34, 40, toward the discharge outlet 26. High pressure working fluid is discharged into a discharge chamber 48 arranged adjacent a downstream end of the rotors 28, 30 and is provided to a component (not shown) located downstream of the compressor 20 via the outlet or discharge port 26.

As best shown in FIG. 2, the compressor 20 may additionally include an unloading system 50. The unloading system 50 includes at least one valve 52 arranged in fluid communication with a portion of the fluid flow path of the compressor 20. In the illustrated, non-limiting embodiment, the unloading system 50 includes only a single valve 52. However, in other embodiments, the unloading system 50 may include a plurality of valves 52. The valves 52 may be substantially identical, or alternatively, may be different. Further, in embodiments including multiple valves 52, the plurality of valves 52 may be spaced about the periphery housing assembly 22. In an embodiment, each of the plurality of valves 52 is centered about a plane oriented generally perpendicular to the axes A, B of the rotors 28, 30. However, embodiments where one or more of the valves 52 is offset from another of the valves 28, 30 is also within the scope of the disclosure.

With reference to FIGS. 3-6, an example of a valve 52 of the unloading system 50 is illustrated in more detail. In an embodiment, the valve 52 includes a valve body or housing 54 positioned within an opening 56 formed in a portion of the housing assembly 22 generally adjacent a central portion of the rotors. However, it should be understood that in other embodiments, the valve body 54 may be integrally formed as a portion or feature of the housing assembly 22 of the compressor 20. As shown, a first, interior end 58 of the valve body 54 is positioned radially outward of the lobes of the working body 34 of an adjacent rotor 28. A central bore 60 formed in the valve body 54 extends through the interior end 58 to define an inlet opening 62. In an embodiment, an outlet opening 64 is formed in an upstream side 66 of the valve body 54. The valve 52 is positioned such that the outlet opening 64 is aligned with the portion of the fluid flow path defined between an interior surface 68 of the housing assembly 22 and an outer periphery of the working body 34 of an adjacent screw rotor 28. It should be understood that a valve body 54 having another configuration of one or both of the inlet and outlet openings 62, 64 is also within the scope of the disclosure.

Figure 5:
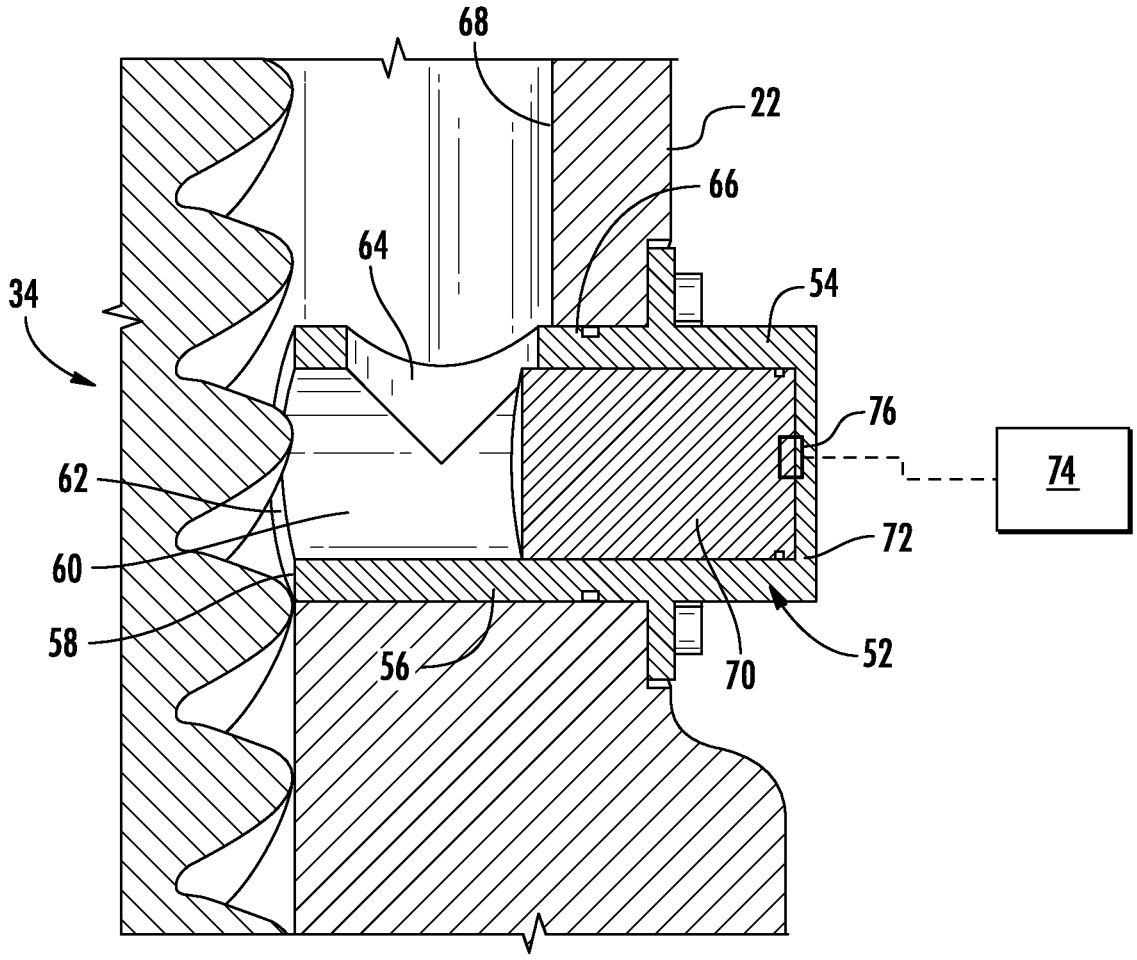
FIG. 5 is a detailed cross-sectional view of a valve of an unloading system of a compressor in a first position according to an embodiment.
Figure 6:
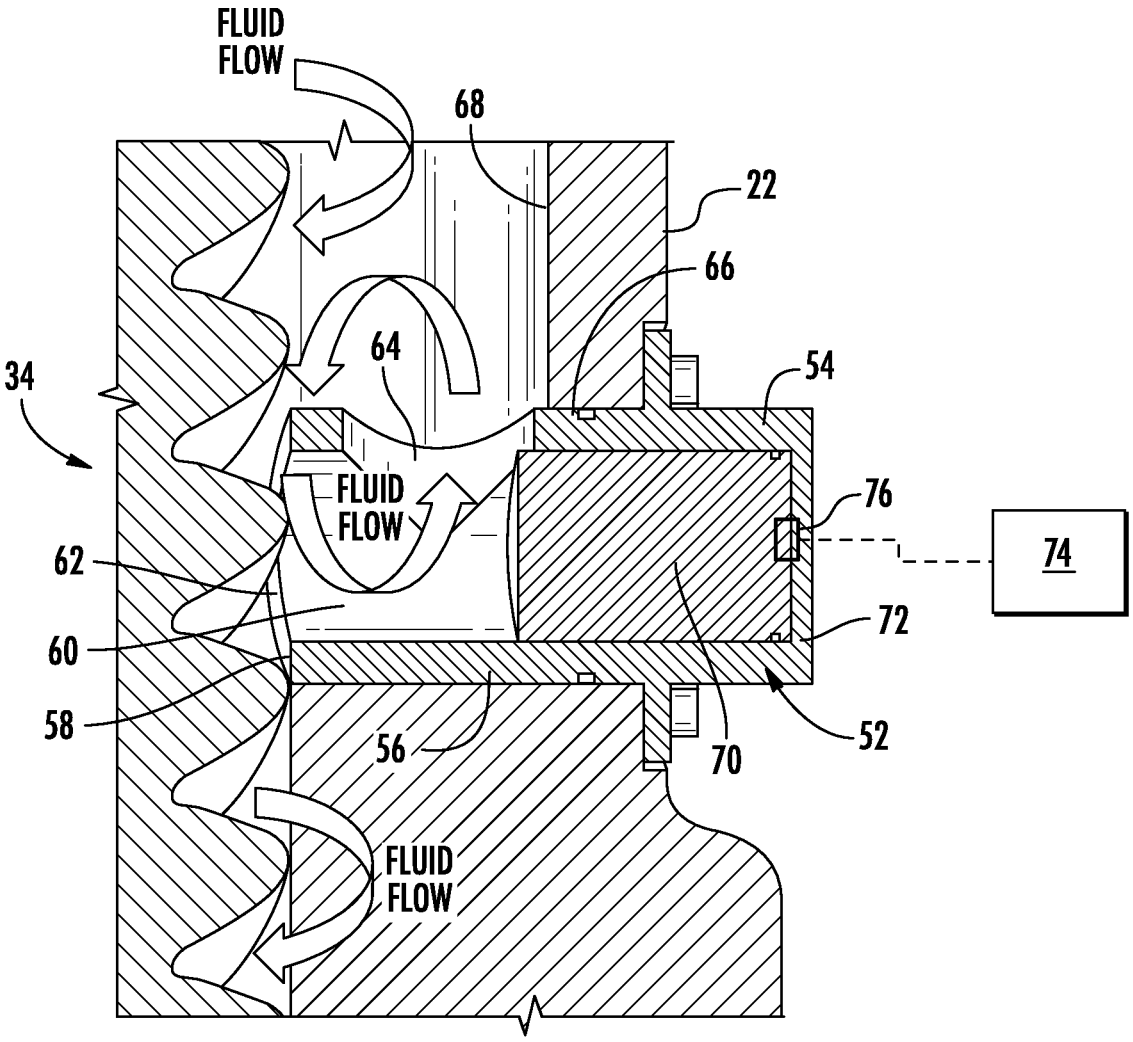
FIG. 6 is a detailed cross-sectional view of a valve of an unloading system of a compressor in a first position according to an embodiment.

A movable member 70, such as a poppet, piston, or plunger for example, is located within the central bore 60 of the valve body 54. The movable member 70 is configured to translate within the central bore 60 between a first, closed position (FIG. 3) and a second, open position (FIG. 5). In the first position, the movable member 70 is located adjacent the interior end 58 of the valve body 54 such that the movable member 70 blocks at least one of the outlet opening 64 and the inlet opening 62. In the illustrated, non-limiting embodiment, when in the first position, the movable member 70 seals both the outlet opening 64 and the inlet opening 62. In the second position, the movable member 70 is generally located adjacent a second, opposite end 72 of the valve body 54. In the second position, the outlet opening 64 and the inlet opening 62 are at least partially arranged in fluid communication with one another such that the fluid at the one or more lobes aligned with the inlet opening 62 may recirculate to an upstream portion of the lobes or working portion 34 via the outlet opening 64.

In an embodiment, the movable member 70 is operably coupled to a drive mechanism, illustrated schematically at 74, such as a solenoid for example. The drive mechanism 74 may be embedded within the valve body 54, the housing assembly 22, or alternatively, may be located external to the compressor 20. The drive mechanism 74 is operable to move the movable member 70 within the valve body 54 between the first position and the second position. In embodiments where the drive mechanism 74 is a solenoid, the solenoid may be selectively energized. When the solenoid is energized, the magnetic field generated may attract the material of the movable member 70, causing the movable member 70 to translate within the central bore 60 between the first position and the second position. Upon removing the power provided to the solenoid, the magnetic field is eliminated.

In an embodiment, the movable member 70 is configured to automatically translate from the second position back to the first position. This automatic translation may occur due to gravity. Alternatively, a biasing member 76 may be disposed between the movable member 70 and an end of the central bore 60. When the movable member 70 is moved into the second position via the drive mechanism 74, kinetic energy is stored in the biasing member 76, such as via compression of the biasing member 76. Upon removal of power from the solenoid, and therefore the force opposing the biasing force of the biasing member 76, the biasing force will bias the movable member 70 back to the first position, to seal at least one of the outlet opening 64 and the inlet opening 62. However, it should be understood that embodiments where the drive mechanism 74 is operable to translate the moveable member 70 from the first position to the second position and from the second position to the first position are also within the scope of the disclosure.

During normal operation of the compressor 20, the one or more valves 52 of the unloading system 50 are typically in the first, closed position, such that one or both of the inlet opening 62 and the outlet opening 64 are sealed. In the closed position, the unloading of the compressor 20 is limited by the speed of operation of the compressor 20. To achieve additional unloading when the compressor 20 is already at a lower limit speed of operation, one or more of the valves 52 of the unloading system 50 are opened, i.e. the movable member 70 is translated from the first position to the second position. As a result, the overall fluid flow through the compressor 20 is reduced. It should be understood that in embodiments where the unloading system 50 included a plurality of valves 52, the amount of additional unloading achieved may be customized by operating a desired portion of the valves 52. When additional loading of the compressor 20 is required, the open valves 52 are closed by transitioning the movable members 70 from the second position to the first position. Further, it should be understood that the additional unloading achieved via operation of the valves 52 of the unloading system 50 is not limited to use when the compressor 20 is at a lower limit speed of operation.

A compressor 20 having an unloading system 50 as illustrated and described herein allows additional unloading of the compressor 20 beyond the current limits defined by the minimum speed. This additional unloading allows for greater operational efficiency at low load conditions while still allowing the compressor to meet full load requirements when needed.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A variable speed compressor comprising:

a housing assembly having a suction port and a discharge port;

a motor disposed within the housing assembly;

at least one rotatable element mounted within the housing assembly, the at least one rotatable element driven by the motor about an axis of rotation; and an unloading system including at least one valve positioned at a central portion of the at least one rotatable element along the axis of rotation, the at least one valve having an inlet opening adjacent an outer periphery of the at least one rotatable element and an outlet opening arranged in fluid communication with a fluid flow path extending between an interior surface of the housing assembly and the at least one rotatable element;

wherein the at least one valve includes a valve body having a first side, a second side distinct from the first side, a central bore, an inlet opening formed at the first side and arranged in fluid communication with the central bore, an outlet opening formed at the second side and arranged in fluid communication with the central bore and a movable member arranged within the central bore, the movable member being movable between a first position and a second position, wherein the at least one valve of the unloading system is operable to supplement an unloading of the variable speed compressor defined by an operational speed of the variable speed compressor when the movable member is in the second position;

wherein a biasing member is disposed between the movable member and the valve body and a biasing force of the biasing member is configured to automatically transform the movable member from the second position to the first position.

2. The variable speed compressor of claim 1, wherein the at least one valve is positioned within an opening formed in the housing assembly.

3. The variable speed compressor of claim 1, wherein the at least one valve is aligned with a working portion of the at least one rotatable element.

4. The variable speed compressor of claim 1, wherein the at least one valve includes a plurality of valves spaced about a periphery of the housing assembly.

5. The variable speed compressor of claim 1, wherein the plurality of valves are arranged within a plane oriented substantially perpendicular to the axis of rotation.

6. The variable speed compressor of claim 1, wherein the at least one rotatable element includes at least one lobe and the inlet opening is arranged in fluid communication with the at least one lobe.

7. The variable speed compressor of claim 1, wherein the at least one valve is a poppet valve.

8. The variable speed compressor of claim 1, wherein the movable member is arranged in the first position when the unloading system is non-operational.

9. The variable speed compressor of claim 8, wherein when the movable member is in the first position, the movable member seals both the inlet opening and the outlet opening.

10. The variable speed compressor of claim 1, wherein when the movable member is in the second position, the inlet opening and the outlet opening are fluidly coupled.

11. The variable speed compressor of claim 1, wherein the unloading system further comprises a drive mechanism configured to move the movable member between the first position and the second position.

12. The variable speed compressor of claim 11, wherein the drive mechanism includes a solenoid.

13. The variable speed compressor of claim 11, wherein when the drive mechanism is inactive, the movable member is configured to automatically transform from the second position to the first position.

14. The variable speed compressor of claim 13, wherein the movable member is configured to automatically transform from the second position to the first position via gravity.

15. The variable speed compressor of claim 1, wherein the at least one rotatable element includes a male screw rotor and a female screw rotor.

* * * * *